US011196179B2

(12) United States Patent
Kindt

(10) Patent No.: US 11,196,179 B2
(45) Date of Patent: Dec. 7, 2021

(54) WIDEBAND DUAL-POLARIZED ELECTRICALLY COUPLED AND CONNECTED RADIATORS ON A TRIANGULAR LATTICE

(71) Applicant: The Government of the United States of America, as represented by the Secretary of the Navy, Arlington, VA (US)

(72) Inventor: Rick Kindt, Arlington, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/877,216

(22) Filed: May 18, 2020

(65) Prior Publication Data

US 2020/0366002 A1 Nov. 19, 2020

Related U.S. Application Data

(60) Provisional application No. 62/848,625, filed on May 16, 2019.

(51) Int. Cl.

| | |
|---|---|
| ***H01Q 1/36*** | (2006.01) |
| ***H01Q 21/26*** | (2006.01) |
| ***H01Q 3/26*** | (2006.01) |
| *H01Q 1/24* | (2006.01) |
| *H01Q 1/40* | (2006.01) |
| *H01Q 5/35* | (2015.01) |
| *H01Q 21/30* | (2006.01) |
| *H01Q 1/22* | (2006.01) |

(52) U.S. Cl.

CPC ..... *H01Q 21/26* (2013.01); *H01Q 3/26* (2013.01); *H01Q 1/2283* (2013.01); *H01Q 1/243* (2013.01); *H01Q 1/245* (2013.01); *H01Q 1/40* (2013.01); *H01Q 5/35* (2015.01); *H01Q 21/30* (2013.01)

(58) Field of Classification Search

CPC ..... H01Q 21/26; H01Q 3/26; H01Q 21/30; H01Q 1/245; H01Q 1/243; H01Q 1/40; H01Q 5/35; H01Q 1/2283

See application file for complete search history.

(56) References Cited

U.S. PATENT DOCUMENTS

2020/0144733 A1* 5/2020 Chakraborty ..... H01Q 21/245

* cited by examiner

*Primary Examiner* — Joseph J Lauture

(74) *Attorney, Agent, or Firm* — US Naval Research Laboratory; William P. Ladd

(57) ABSTRACT

Systems and methods are provided for implementing wideband radiators that conform to regular equilateral triangular lattices with little to no performance compromise for typical offset pairs of dual-polarized element arrangements. This general radiator family/group/configuration can be referred to as the Slant Tri-V (STV) element based on the basic characteristic set of this radiator group and relative differences to conventional array elements normally seen on rectangular or triangular lattice arrangements. The STV array element has wideband, dual-polarized operation and conforms to the most efficiently sampled array lattice for the lowest array element count possible for phased arrays.

20 Claims, 19 Drawing Sheets

WIDEBAND DUAL-POLARIZED ELECTRICALLY COUPLED AND CONNECTED RADIATORS ON A TRIANGULAR LATTICE

CROSS REFERENCE TO RELATED APPLICATIONS

This application claims the benefit of U.S. Provisional Patent Application No. 62/848,625, filed on May 16, 2019, which is incorporated by reference herein in its entirety.

FEDERALLY SPONSORED RESEARCH AND DEVELOPMENT

The United States Government has ownership rights in this invention. Licensing inquiries may be directed to Office of Technology Transfer at US Naval Research Laboratory, Code 1004, Washington, D.C. 20375, USA; +1.202. 767.7230; techtran@nrl.navy.mil, referencing Navy Case Number 111169-US3.

FIELD OF THE DISCLOSURE

This disclosure relates to phased array radiators, including wideband array radiators.

BACKGROUND

Dual-polarized pairs of wideband radiators can be implemented using a square (rectangular) grid, which can be referred to as an egg-crate lattice for offset pairs of orthogonal elements. The square lattice is simple and convenient for radiator layout, as it forms straight, regular rows and columns of element sub arrays out of linear arrays of single-polarized elements, allows placement of orthogonal ports on convenient regular grids, and for optimal half-wavelength spacing of elements at the highest frequency of operation, allows for wide scans over the complete volume of visible space without unwanted/catastrophic grating lobes. The two dimensions of the square lattice (often horizontal and vertical, slant-left and slant-right, or forward-slant and back-slant, or simply/equivalently X & Y for common coordinate systems) are geometrically perpendicular/orthogonal, and thus are intuitively well-suited for dual-polarized element pairs requiring orthogonal polarization and placement. These egg-crate element configurations are visually pleasing in that they decompose to linear arrays of single-polarized elements, often the starting point for array designers before moving on to the more complex dual-linear polarization arrays having orthogonal element pairs.

On many levels the simple and elegant square lattice can be an advantageous layout for complex and potentially expensive phased array apertures. Particularly for advanced electronically scanned array (ESA) systems, each element channel (i.e. active electronics chain) incurs a substantial cost, such that there is a strong desire to minimizing the total number of elements required to populate an aperture of a given size (for arrays, gain is largely driven by aperture size, not number of radiators). Using the optimal element sampling at exactly half-wavelength spacing $\lambda_{high}/2$ for the highest frequency of operation $f_{high}$, results in nearly the lowest possible element counts (and by extension lowest cost for a given aperture size), with scan operation over full visible space, sans grating lobes. However, square lattices have some disadvantages, such as a higher element count than other configurations, such as triangular lattices used in accordance with embodiments of the present disclosure.

BRIEF DESCRIPTION OF THE DRAWINGS/FIGURES

The accompanying drawings, which are incorporated in and constitute part of the specification, illustrate embodiments of the disclosure and, together with the general description given above and the detailed descriptions of embodiments given below, serve to explain the principles of the present disclosure. In the drawings.

Figure 1:
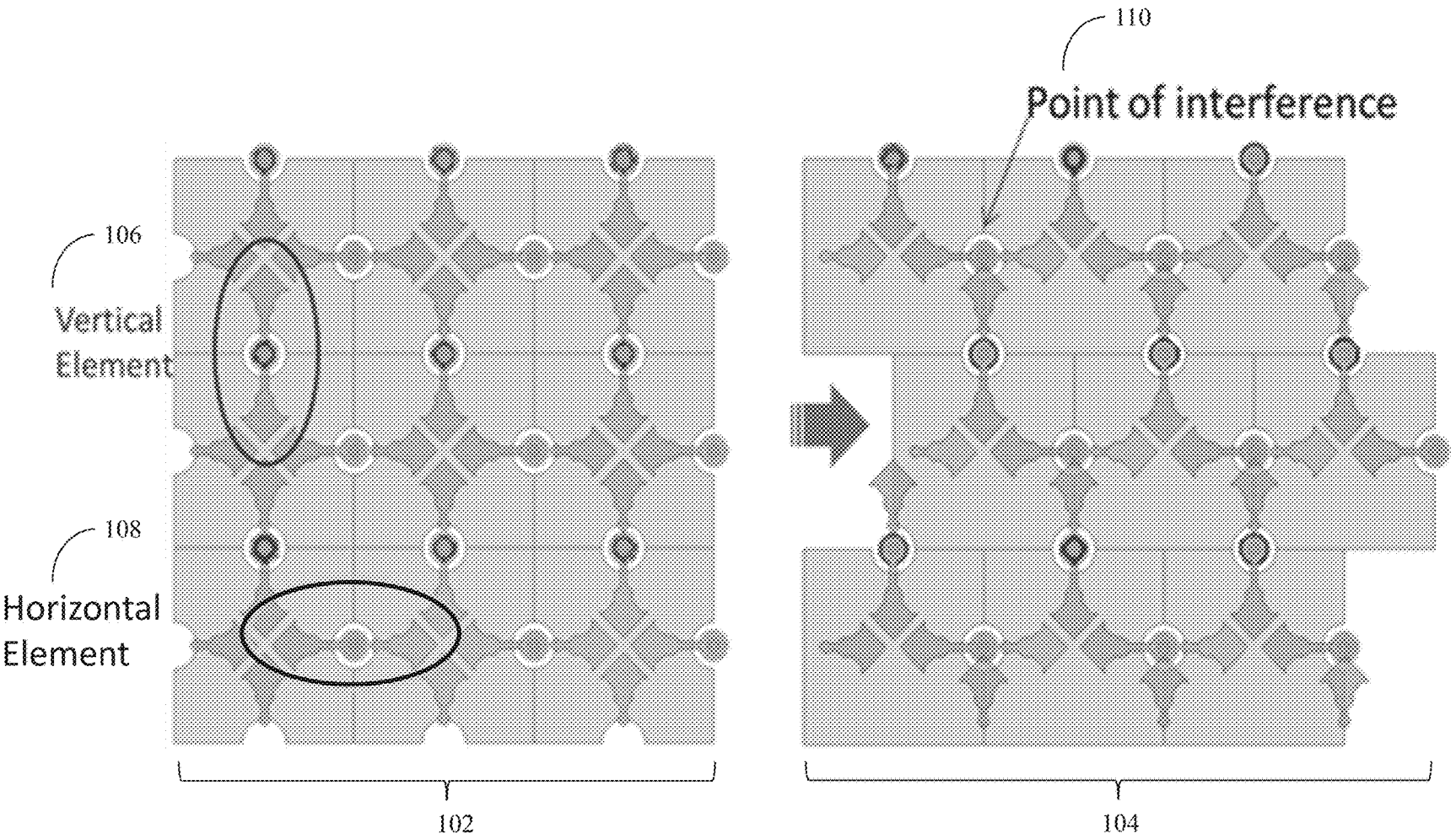
FIG. 1 shows a diagram of an egg-crate (square) lattice for dual-polarized, offset radiators and a diagram 104 of an equilateral triangle lattice adaptation demonstrating registration incompatabilities.

mode partitions with breaks/perforations in the partition in accordance with an embodiment of the present disclosure.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

In the following description, numerous specific details are set forth to provide a thorough understanding of the disclosure. However, it will be apparent to those skilled in the art that the disclosure, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to understand that such description(s) can affect such feature, structure, or characteristic in connection with other embodiments whether or not explicitly described.

1. Overview

Embodiments of the present disclosure provide systems and methods for implementing wideband radiators that conform to regular equilateral triangular lattices with little to no performance compromise for typical offset pairs of dual-polarized element arrangements. This general radiator family/group/configuration can be referred to as the Slant Tri-V (STV) element based on the basic characteristic set of this radiator group and relative differences to conventional array elements normally seen on rectangular or triangular lattice arrangements. The STV array element has wideband, dual-polarized operation and conforms to the most efficiently sampled array lattice for the lowest array element count possible for phased arrays.

2. Triangular Lattice Configurations

Triangular (or diamond) lattice configurations can give an additional reduction in element counts over an optimally-sampled square lattice. This alternative lattice arrangement changes the mapping of where grating lobes appear in visible space with array scanning. The triangular lattice has roughly a 15.5% increase in element spacing (or equivalently, a 15.5% reduction in the number of elements) over the optimally sampled square array lattice at full scan volume capability, without inducing grating lobes in visible space. Though the triangular lattice is not as simple and elegant as the square lattice, this 15.5% savings in element counts can make a notable impact on both overall cost and electronics packing density, and is thus preferred for some system configurations.

Triangular lattices can be used with decoupled (or weakly coupled) elements such as common patch antennas, narrowband dipoles, etc. As long as the radiators are not strongly coupled (or connected) with neighboring elements, it makes it much easier to change their relative configuration (i.e., square lattice to triangular lattice) without drastically affecting performance. The change to triangular lattice can have a significant impact on highly-coupled, and particularly electrically-connected, elements. This is less of an issue for single-polarized radiators and linear arrays, as even highly-coupled single-polarized elements can often be made to conform to a triangular lattice and re-tuned for reasonably good performance.

However, adding in a second orthogonal polarization for dual-polarized operation complicates things substantially, since unlike arrays on a square lattice, it seems counterintuitive that two orthogonal radiator polarizations can be made electrically orthogonal or geometrically symmetric on a triangular lattice. Simultaneously forcing the two orthogonal polarizations to conform to the triangular grid while maintaining the same relative electrical coupling to adjacent neighbor elements, is problematic. Looked at in a different way—the two-dimensional vectors (x-y or H-V) defining a square lattice are orthogonal to each other, whereas for the triangular lattice, this is not the case, as the sides of an equilateral triangle form 60-degree angles, unlike the 90-degree angles in the square lattice. This mapping difficulty (from square grid to triangular grid) is most obvious when trying to migrate from an egg-crate configuration of dual-polarized, electrically coupled or connected elements to the triangular lattice.

The difficulty of migrating from a dual-polarized egg-crate lattice for offset-phase-center elements is illustrated in FIG. 1. FIG. 1 shows a diagram 102 of an egg-crate (square) lattice for dual-polarized, offset radiators and a diagram 104 of an equilateral triangle lattice adaptation demonstrating registration incompatibilities. Diagram 102 shows exemplary vertical element 106 and exemplary horizontal element 108. As shown by FIG. 1, shifting the element pairs to conform to an equilateral triangle arrangement results in substantial interference (e.g., as shown by point of interference 110) for highly coupled (or connected) elements.

Figure 2:
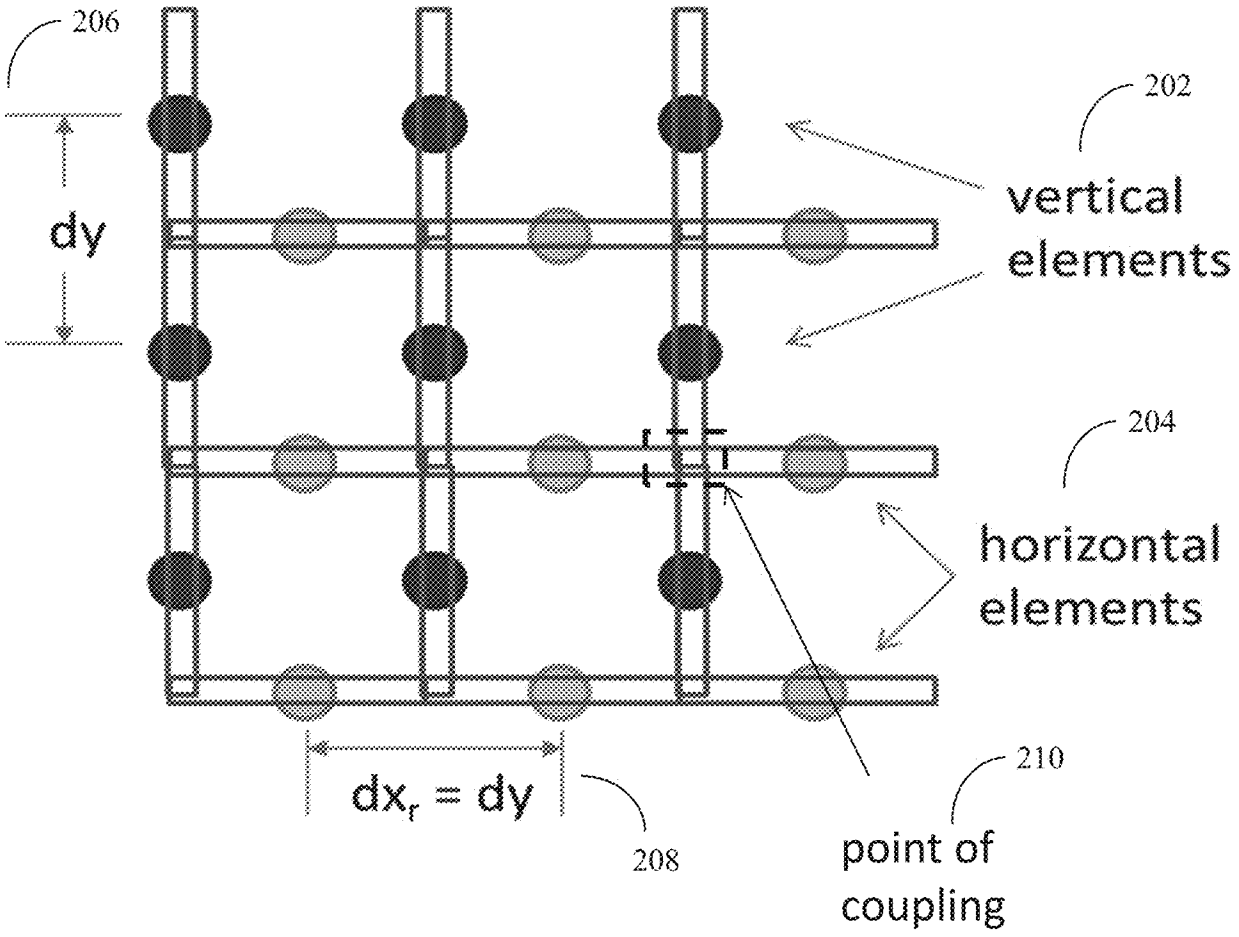
FIG. 2 shows a diagram of an exemplary configuration for prototypical dual-polarized radiators on a regular (square) egg-crate lattice.

3. Square Lattice Configurations for Wideband Dual-Polarized Arrays of Offset Pair Radiators FIG. 2 shows a diagram of an exemplary configuration for prototypical dual-polarized radiators (elements) on a regular (square) egg-crate lattice. FIG. 2 includes vertical ports 202 and horizontal ports 204. Each of the radiators is represented as a bar (without loss of generalization), and is either connected or coupled 210 at its ends (electrically connected or coupled elements). Generally speaking, it is largely this coupling or connection at the ends of the bars that enables wideband operation at the aperture level, though there can be other bandwidth limiting factors such as the feed transition, etc., that are beyond the scope of this discussion. For grating-lobe-free scans in visible space, dx and dy can be no more than $\lambda_{high}/2$. FIG. 2 shows vertical (dy) spacing 206, which in FIG. 2 is equal to the horizontal (dx) spacing 208.

Figure 3:
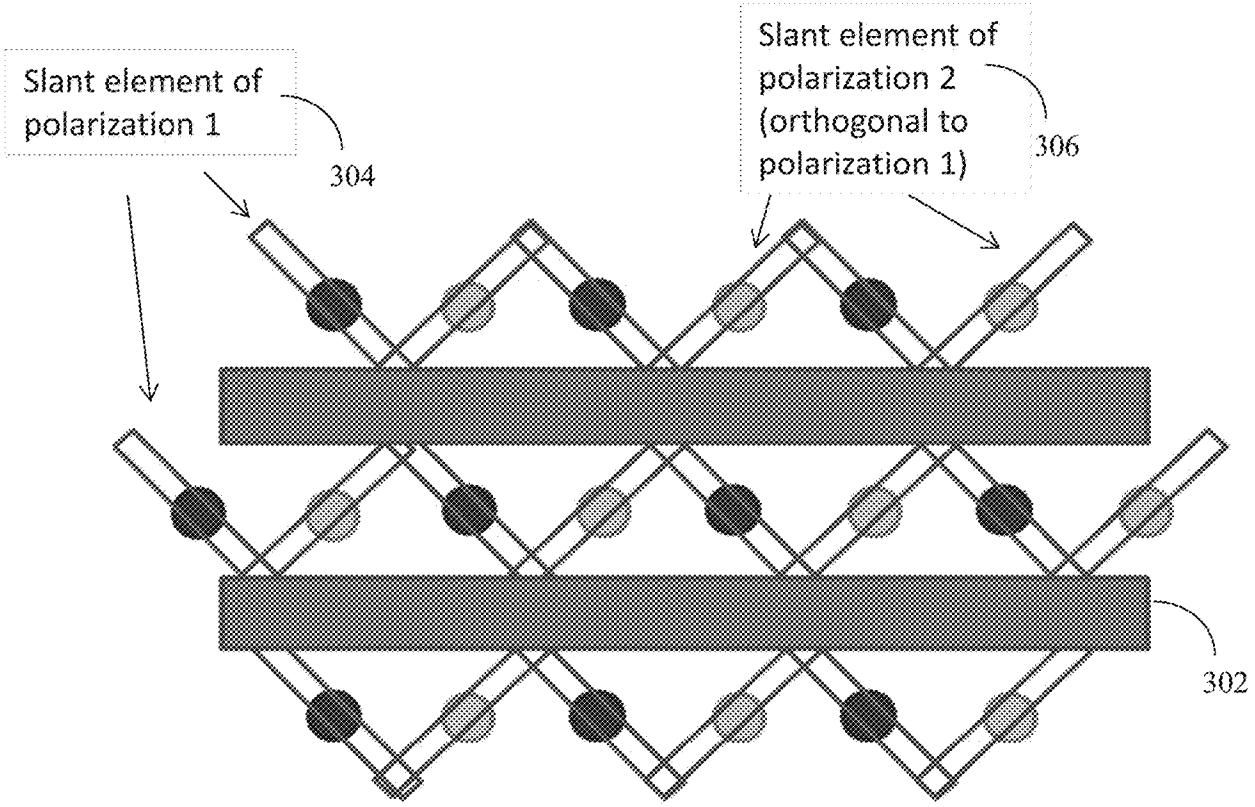
FIG. 3 shows a diagram of a Slant Tri-V (STV) element in accordance with an embodiment of the present disclosure.

FIG. 3 shows a diagram of a Slant Tri-V (STV) element in accordance with an embodiment of the present disclosure.

FIG. 3 shows exemplary slant elements of a first polarization 304 and exemplary slant elements of a second polarization 306 that is orthogonal to the first polarization. Before examining radiator-level differences in the STV, we first discuss exemplary array level differences between a square or rectangular egg-crate lattice array and a triangular STV lattice. In an embodiment, the STV elements, generally speaking, will be oriented at 45 degrees from typical egg-crate configurations of dual-polarized pairs of offset elements, (though this is mainly for visualization, as aperture rotation does not change inherent operation). Still, note that, in an embodiment, the dual-polarized element pairs of the STV maintain their offset, orthogonal relative orientation. As a side note, this places the respective ports of the orthogonal element pairs into alternating alignment on a rectangular grid.

In an embodiment, assuming the same scan requirements of the square egg-crate lattice of FIG. 2, the vertical (dy) spacing of the STV elements in FIG. 3 remains the same. However, in an embodiment, the horizontal placement (dx) is increased by a factor of $$\frac{2}{\sqrt{3}}.$$

In an embodiments, every other row of element pairs in the array lattice is shifted (by half a cell) to create an equilateral triangle layout for adjacent pairs of STV radiators. In an embodiment, this arrangement satisfies requirements of a triangular lattice for achieving grating-lobe free scanning over visible space. However, the increased lattice spacing $$\left(\frac{2}{\sqrt{3}}\right)$$

relative to the rectangular egg-crate lattice can make the STV susceptible to additional scan blindness concerns associated with surface/guided waves.

In an embodiment, for mitigation of scan blindness, an exemplary STV element can utilize a mode partition (wall) 302, as shown in FIG. 3. In an embodiment, the structure of this mode partition 302 can vary depending on the STV element architecture and can be largely used for structural support, as will be discussed for several element-level embodiments of the STV to follow. Note that, unlike the case of dual-polarized egg-crate configurations of radiators on a square lattice, an exemplary STV element does not decompose into linear arrays of single-polarized elements if one polarization is removed. Also note that, while the feed ports are on a rectangular lattice, the radiators (viewed as individual polarizations and also element pairs) of an exemplary STV element are on an equilateral triangular lattice, assuming the $$\frac{2}{\sqrt{3}}$$

relative increase for dx lattice spacing is satisfied. An array aperture architecture in accordance with an embodiment of the present disclosure includes dual-polarized, offset (orthogonal) element pairs of radiators that can still be connected or highly coupled for maintaining wideband operation.

4. Exemplary Radiator-Level STV Element Details

Figure 4:
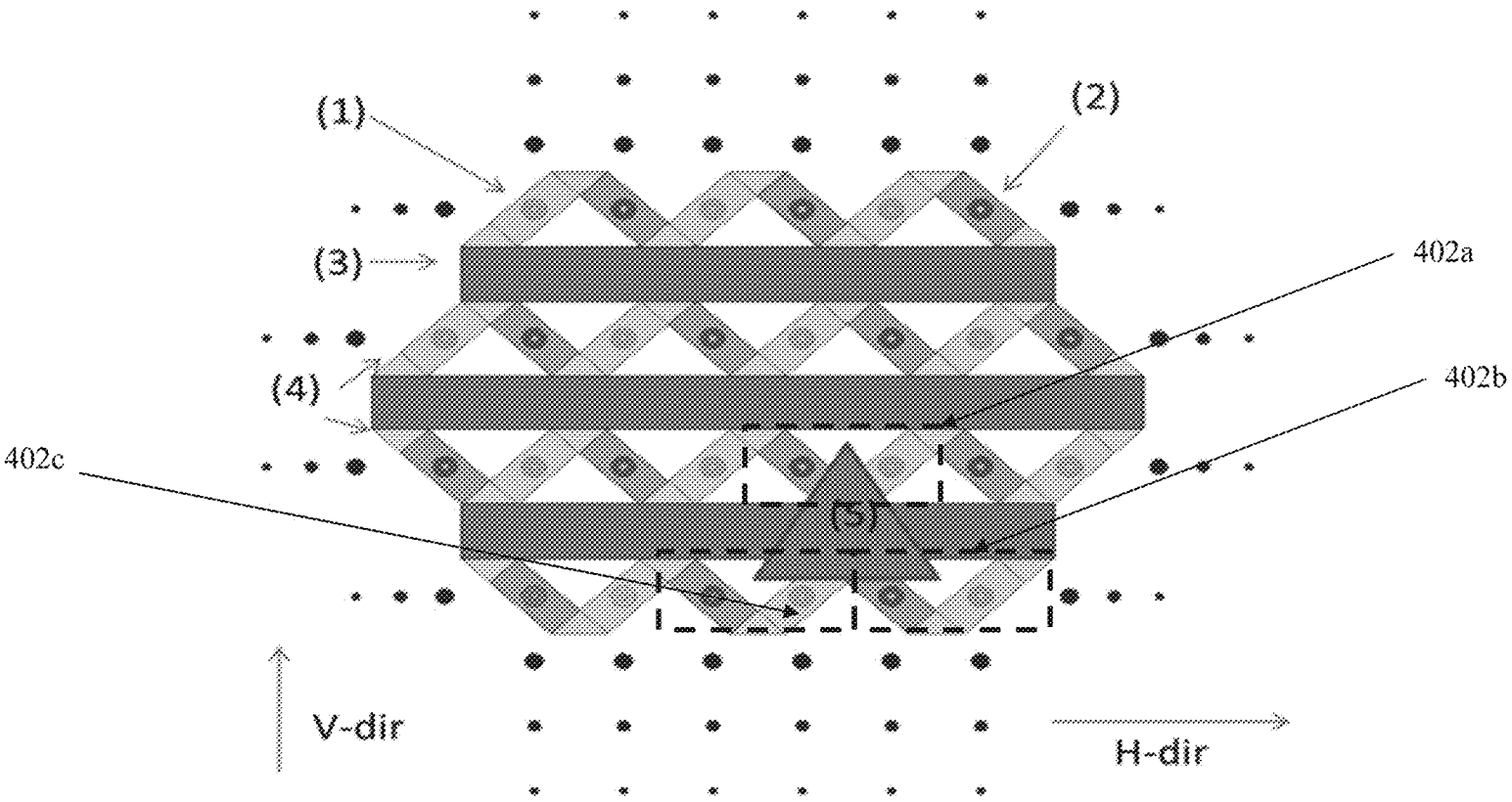
FIG. 4 is a diagram illustrating an exemplary STV array in accordance with an embodiment of the present disclosure.

Radiator level details of an exemplary STV element will now be discussed. FIG. 4 is a diagram illustrating an exemplary STV array in accordance with an embodiment of the present disclosure. The STV array of FIG. 4 can be suitable for construction via metal machining (subtractive) or additive manufacturing. Without loss of generality, it is understood that this embodiment applies to array structures, such that the number of elements can change depending on the application, the array consisting of repeating features on a regular grid or lattice. Shown in FIG. 4 is a sub-section of the array that could repeat in any direction and have any number of elements required for the system.

FIG. 4 shows a forward-slant element of the first polarization 1, and a back-slant element of the second (orthogonal) polarization 2. In an embodiment, the relative spacing between forward-slant element of the first polarization 1 and back-slant element of the second (orthogonal) polarization 2 in the H-direction (horizontal) is not fixed, though optimally would be set for equidistant port placement. In an embodiment, the spacing in the H-direction between forward-slant elements of the first polarization 1 and between back-slant elements of the second (orthogonal) polarization 2 will optimally be $$\frac{2}{\sqrt{3}}$$

times the square lattice spacing required for grating-lobe free scan operation, or half-wavelength spacing at the highest frequency of operation, $$\frac{2}{\sqrt{3}}\frac{\lambda_{high}}{2}.$$

Stated numbers are simply exemplary suggestions for an equilateral triangle, and spacing in the H direction can be varied depending on system and performance needs. In the V direction, the relative spacing between rows of ports or individually forward-slant elements of the first polarization 1 and back-slant elements of the second (orthogonal) polarization 2 should optimally be equal to half a wavelength at the highest frequency operation, $$\frac{\lambda_{high}}{2}.$$

In an embodiment, this is an optimal suggestion for grating lobe considerations. Spacing of elements in the V direction can also be altered depending on system performance requirements.

FIG. 4 also shows the mode partition bar or rail 3. In an embodiment, the mode partition bar/rail 3 satisfies a number of critical performance and structural needs. First, it provides and electrical connectivity path in the vertical direction between horizontal rows of elements, in additional to structural support in that dimension, either or both of which may be necessary. Electrical connectivity, whether it is by hard electrical contact or capacitive electrical coupling, is generally required for wideband array radiator operation. This requirement is partly satisfied by the mode partition connection/coupling to the elements. In an embodiment, mode partition bar or rail 3 also provides a symmetry plane for setting up desirable radiation modes across elements vertically relative to each other.

In an embodiment, without mode partition bar or rail 3, radiator performance would not reach ideal levels. At the same time that mode partition bar or rail 3 enables desired radiation modes to form, it can simultaneously prevent certain destructive modes from forming. For example, most planar material layer and periodic lattice structures residing on a metal backing plane (as most structurally-supported phased arrays typically include) will inadvertently support undesired guided waves (in the operating range between $f_{low}$ and $f_{high}$) that cause scan blindness for normally operating scanning phased arrays. In an embodiment, compared to a square lattice array, a triangle lattice array can be more susceptible to formation of these guided wave modes within operational frequency ranges, hence additional measures can be taken to avoid scan blindness. Under most conditions, mode partition bar or rail 3 can prevent in-band scan blindness modes. In an embodiment, mode partition bar or rail 3 may simply bridge the vertical gap to connect horizontal rows of elements, or more typically, can also be used to provide connection or coupling to the grounded array metal backplane, for both structural and/or mode grounding considerations.

In an embodiment, mode partition bar or rail 3 meets the slant elements at tri-mold region 4, which we refer to as the tri-mold region, since it somewhat resembles or mimics a molding as would be used in building construction. In an embodiment, the tri-mold region 4 connects horizontally-adjacent elements with either electrical contact or coupling (shorted or open capacitive), and similarly connects the elements to the mode partition. In an embodiment, for typical connected elements, i.e., element types that achieve wideband operation partially through electrical contact with neighboring elements, the elements of the STV achieve hard electrical contact to the mode partition through tri-mold region 4. In an embodiment, for coupled wideband elements that normally establish wideband operating mode through capacitive coupling with neighboring elements, the STV can enable capacitive coupling at the mode partition. In an embodiment, if the mode partition is removed, and the elements are collapsed in the vertical dimension to fill the void, the array lattice returns to being a square lattice, albeit in slant (e.g., rotated 45 degrees) orientation.

Figure 5:
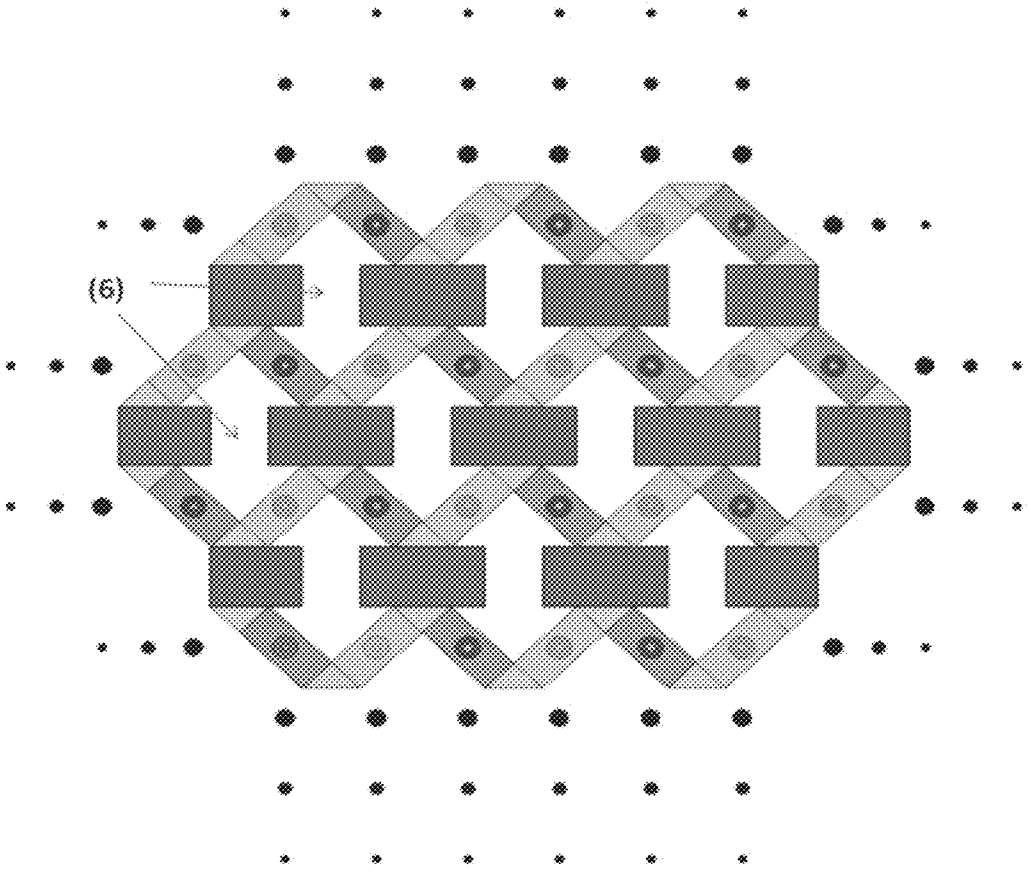
FIG. 5 shows a diagram of an STV with a perforated mode partition in accordance with an embodiment of the present disclosure.

Note that, in the embodiment illustrated by FIG. 4, the mode partitions orient horizontally, between horizontal rows of alternating STV elements. This is by design, as it allows the rows of STV element pairs to "slide" relative to each adjacent rows. This can be done without breaking the necessary mode conditions for wideband operation, such that alternating rows of elements can be aligned in various ways, including vertically stacked or staggered precisely to align the STV element pairs onto an equilateral triangular lattice. FIG. 4 illustrates this showing that the STV element pairs can be aligned on a perfect equilateral triangle 5. Note that, in an embodiment, triangle 5 is not a physical triangle but is used to show the alignment of STV element pairs in a triangular shape. In FIG. 5, regions 402*a*, 402*b*, and 402*c* are highlighted to show this triangular shape.

Another distinguishing feature of an STV element in accordance with an embodiment of the present disclosure is that if one of the element polarizations are removed, the STV does not decompose into linear arrays, unlike the case of egg-crate square or rectangular lattice arrays. That is to say, for the egg-crate array lattice, if one of the element polarizations are removed from the arrangement (e.g., the vertical elements), the configuration can simplify into linear arrays of elements (e.g., horizontal elements) that will often operate will little need for additional tuning. For the STV, removing one of the element polarizations will result in an irregular lattice arrangement that may not function or may not be self-supportive.

Some ways of implementing mode partition bar or rail 3 can have disadvantages, such as causing interference and/or inhibiting magnetic field formation. In an embodiment, mode partition bar or rail 3 can be implemented and/or replaced with a polarizing structure that alleviates these disadvantages. For example, in an embodiment, mode partition bar or rail 3 can be implemented using a polarizing structure comprised of vertical or horizontal layers of material(s) (e.g., dielectric material(s)) with gaps in between layers that allow magnetic fields (e.g., loop currents) to form. In an embodiment, such a polarizing structure can also cause less interference than a solid bar used to implement mode partition bar or rail 3.

In an embodiment, it is not critical that the mode partition be a continuous structure for the STV to be effective. Rather, in an embodiment, depending on the implementation, it could be advantageous if the mode partition is perforated or features breaks in the partition. FIG. 5 shows a diagram of an STV with a perforated mode partition in accordance with an embodiment of the present disclosure. FIG. 5 shows perforations 6, which can have certain advantages over other implementations. For example, it is often the case for planar printed wideband radiators (such as coupled dipoles) that perforating the lattice structure assists in mitigating some undesired guided waves. Similarly, for the case of machined metal radiators such as Vivaldi notches or more recently lower-profile flares (some examples being the Balanced Antipodal Vivaldi Antenna or BAVA, Frequency-scaled Ultra-wide Spectrum Element or FUSE, etc.), it may be convenient to manufacture perforations into the array structure for weight reduction, component shaping, etc. The shape of the mode partition is flexible, could be continuous or feature multiple perforations or breaks, but in general must exist in at least one instance per pair of elements in the array. Similarly, the perforation of the mode partition can be altered in shape or frequency and tuned to meet either performance or manufacturing requirements.

Figure 6:
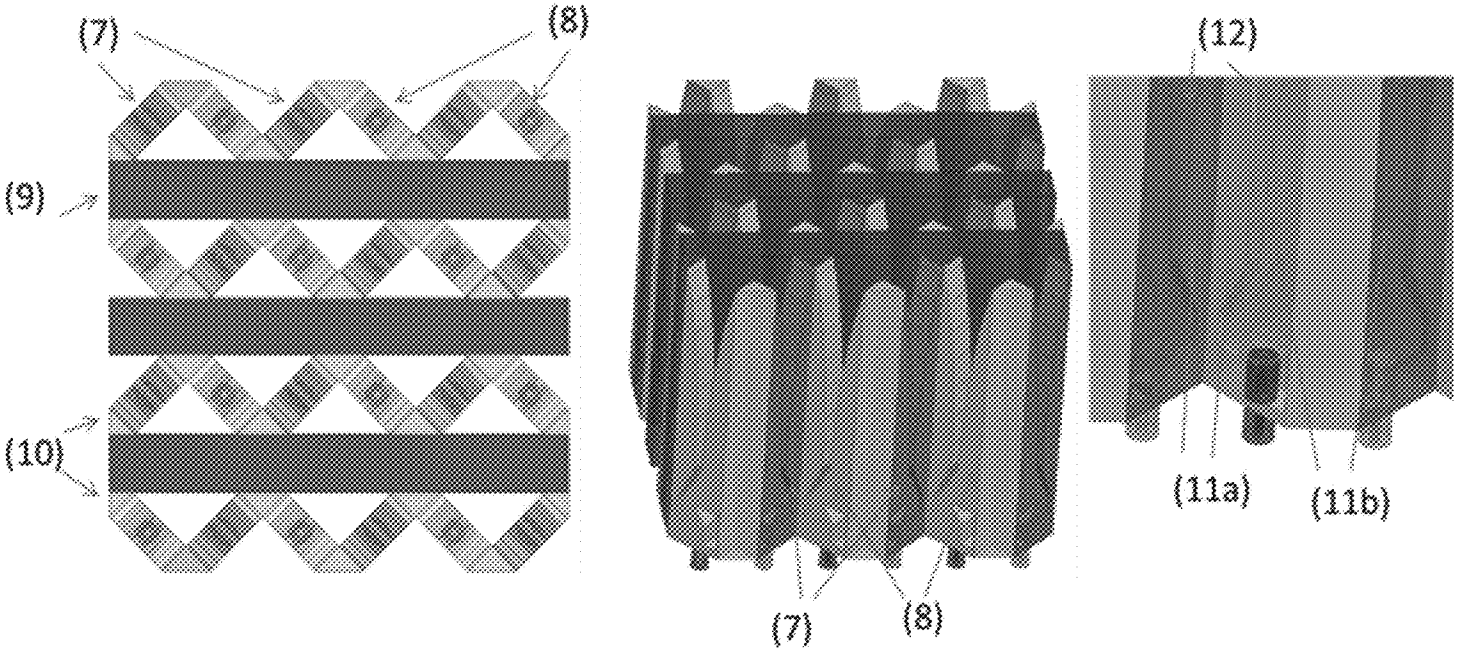
FIG. 6 shows diagrams of a wideband STV not on a triangular lattice with full mode partitions in accordance with an embodiment of the present disclosure.

FIG. 6 shows diagrams of a wideband STV on a triangular lattice with full mode partitions in accordance with an embodiment of the present disclosure. Specifically, FIG. 6 shows an embodiment of the STV Vivaldi or Flared Notch, in this case metal machined Vivaldi or flared notches. FIG. 6 shows the forward-slant STV Vivaldi is indicated 7 and the back-slant STV Vivaldi 8. In FIG. 6, the elements are electrically connected to the mode partition 9 and are blended through hard electric contact with the tri-mold 10. In FIG. 6, the mode partition 9 runs the length of the Vivaldi flares. Each flare consists of a grounded flare 11*a* that shares a common ground with the array backplane and outer coaxial conductor and also a feed flare 11*b* that has a primary contact with the center pin of the coaxial feed line. In the STV element family, each notch, whether it is forward slant or backward slant, does not directly couple to the next element over of the same polarization as would be the case in linear arrays of single-polarized elements or the common dual-polarized egg-crate lattice arrangement of array elements. In FIG. 6, alternating polarizations of elements couple at the mode partition through their respective tri-molds. FIG. 6 also shows the flare of the radiator "throat" 12.

Note that if the mode partition is completely removed by overzealous perforation operations, the STV array will likely experience unwanted mode resonances. One embodiment of the STV Vivaldi would have the common ground flares of the forward-slant and back-slant elements tied together with the tri-mold on the same side of the mode partition. A second embodiment would have one of the polarizations reversed, such that the feed flare of one polarization is most directly tied to the ground flare of the second polarization. Choice of embodiment can not only affect the relative phasing of the separate polarizations for operational use, but may also have frequency-dependent consequences on orthogonal port isolation.

Figure 7:
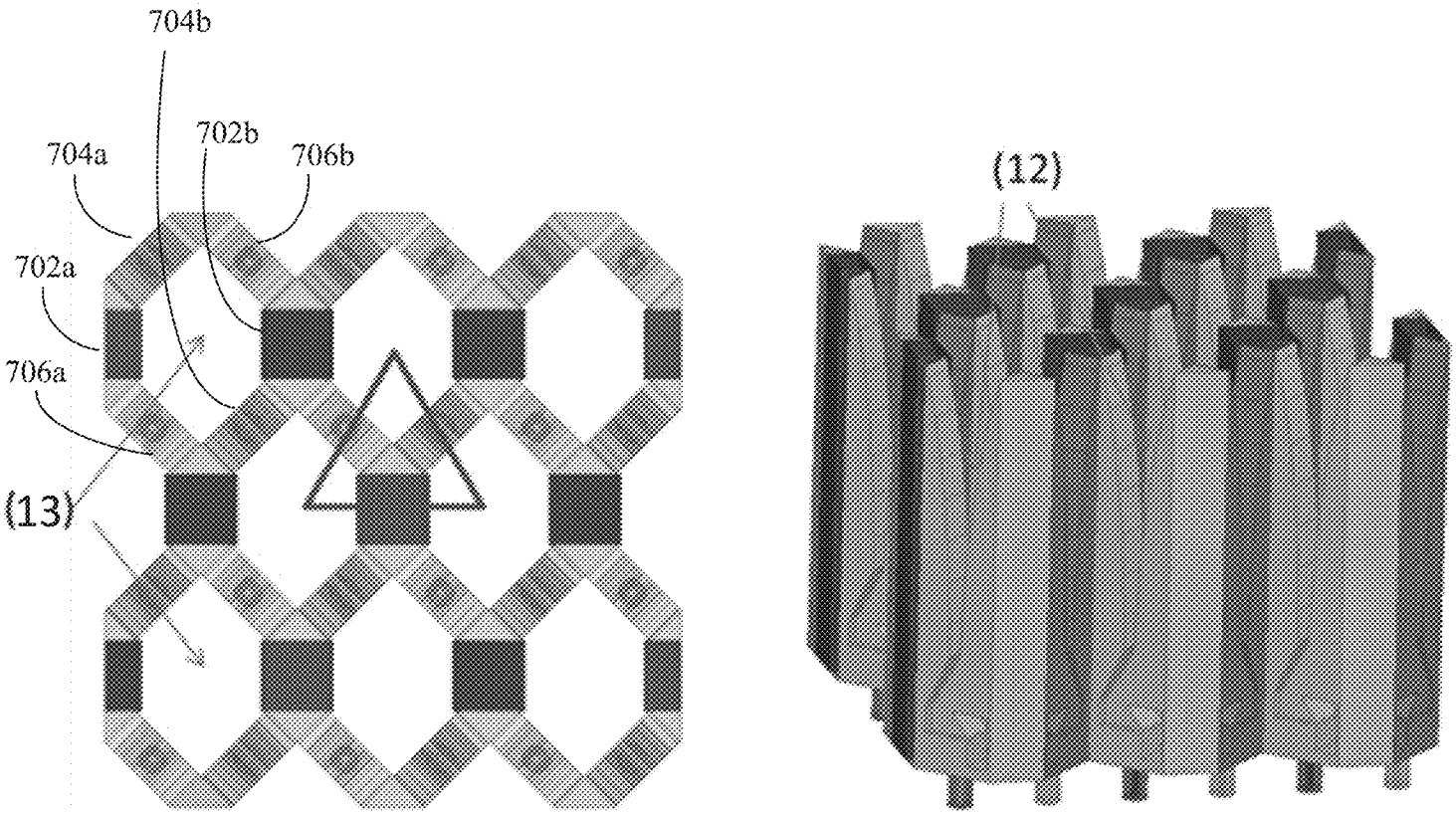
FIG. 7 shows another embodiment of the STV notch in accordance with an embodiment of the present disclosure.

FIG. 7 shows another embodiment of the STV notch in accordance with an embodiment of the present disclosure. FIG. 7 shows exemplary mode partitions 702*a* and 702*b*. FIG. 7 also shows an exemplary first element of a first polarization 704*a*, an exemplary second element of the first polarization 704*b*, an exemplary first element of a second polarization 706*a*, and an exemplary second element of the second polarization 706*b*. In FIG. 7, the element bodies can be formed by drilling or machining regular perforations 13 on an equilateral triangle grid. The perforations 13 can be circular drill holes, counterbores, or more elaborately-shaped cuts made by EDM (electric discharge machining) without loss of generality, performance, or function. The flare of the radiator "throat" 12 can be made most typically with EDM wire cuts for each of the element polarizations. A single cut for each of the two polarizations (e.g., one for the forward slant, one for the back slant) can trace out the full radiator module without needing to thread or re-thread the wire. The coaxial ports can be placed on a regular, rectangular lattice for electronics convenience. For the specific case of the ideal equilateral triangle lattice, the ports can be positioned at half-wavelength intervals $$\left(\frac{\lambda_{high}}{2}\right)$$

in me vertical affection and $$\frac{\lambda_{high}}{\sqrt{3}}$$

intervals in the horizontal dimension. In an embodiment, this is for grating-lobe-free scans in visible space—these intervals can be changed for closer or wider element intervals depending on needs or constraints.

5. Exemplary Slant Tri-V Planar Dipole and Slot Radiators

Figure 8:
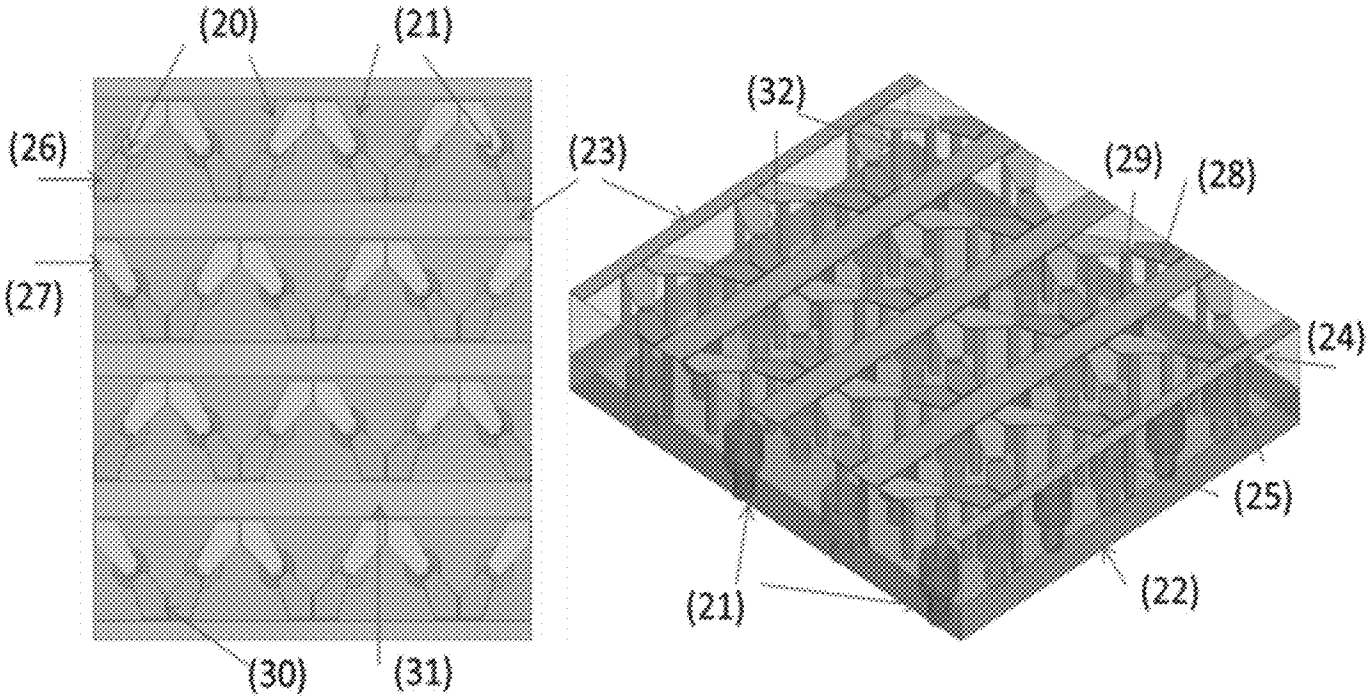
FIG. 8 shows diagrams of a top view (left) and aspect view (right) of a planar printed STV dipole in accordance with an embodiment of the present disclosure.

FIG. 8 shows diagrams of a top view (left) and aspect view (right) of a planar printed STV dipole in accordance with an embodiment of the present disclosure. FIG. 8 shows coaxial feed ports for the forward slant elements 20 and back-slant elements 21. In FIG. 8, the orthogonal feed ports for forward slant elements 20 and back-slant elements 21 alternate in both H and V (x and y) directions. In FIG. 8, the coaxial ports pass through the metallic backing structure 22 of the array. FIG. 8 also shows mode partitions 23. These structures can be conveniently realized as a printed structure on the planar printed supporting material layer 24 or can be printed on a separate layer below or above the radiator dipole layer.

In FIG. 8, the mode partitions are connected to the grounded array metal backing with some number of plated via structures 25. There can be a plurality of plated via structures 25 without loss of generality. In an embodiment, there is at least one plated via structure 25 per STV element pair. FIG. 8 shows a ground pole 26, and a feed pole 27. In an embodiment, ground pole 26 ultimately contacts the grounded array metal backing with a plated through via ground 28. Similarly, a plated through feed via 29 can connect the feed pole to the center pin of the coaxial transmission line. For electrically coupled wideband radiators such as planar printed dipoles, the poles of the dipole can be capacitively coupled 30 to their nearest neighbors and also capacitively coupled 31 to the mode partition. In an embodiment, the poles of the dipole as well as the mode partition can be printed on the same material layer. In alternative embodiments, the separate poles of the dipole could be printed on different material layers, the dipoles could be printed on separate layers from the printed mode partition, etc. FIG. 8 includes a shorting via 32 that can be singular or plural and can appear on the feed-pole or ground-pole of the dipole.

Figure 9:
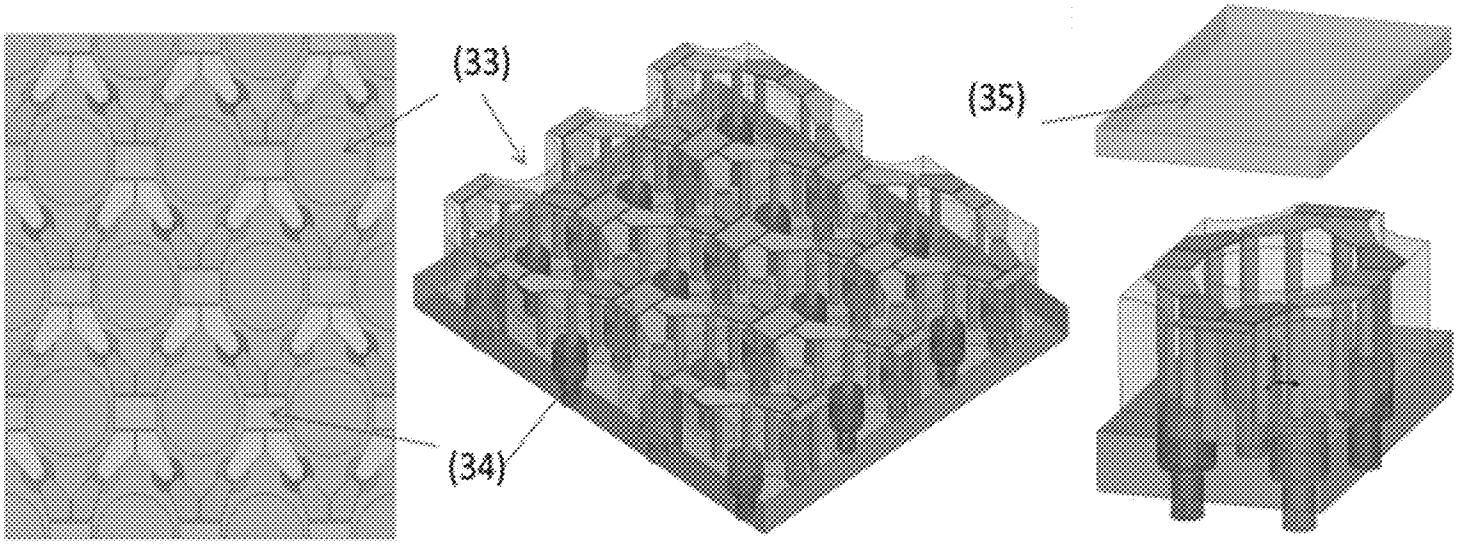
FIG. 9 is another diagram of a planar printed STV dipole in accordance with an embodiment of the present disclosure.

FIG. 9 is another diagram of a planar printed STV dipole in accordance with an embodiment of the present disclosure. FIG. 9 shows a top view (left), aspect view (center), and reduced cell view (right). In FIG. 9, the supporting material layer(s) are perforated 33 in a repeating equilateral triangle pattern, or a repeating pattern that matches the lattice of the STV element array. It is understood that the perforation may not be exactly on an equilateral triangle pattern if the array lattice is not also on a perfect equilateral triangle pattern. Generally speaking, the perforation pattern can follow that of the array lattice pattern. As shown in this embodiment, the perforation bisects the mode partition on a regular basis, creating a perforated mode partition 34. It is understood that this can be done in such a way that the mode partition is still able to serve the function of preventing destructive modes within the operational frequency range of the STV array. Additionally, FIG. 9 notes that the printed material layers may have additional material layers 35 on top of the printed base layers. These additional layers could serve as protection, additional scan matching, etc.

Figure 10:
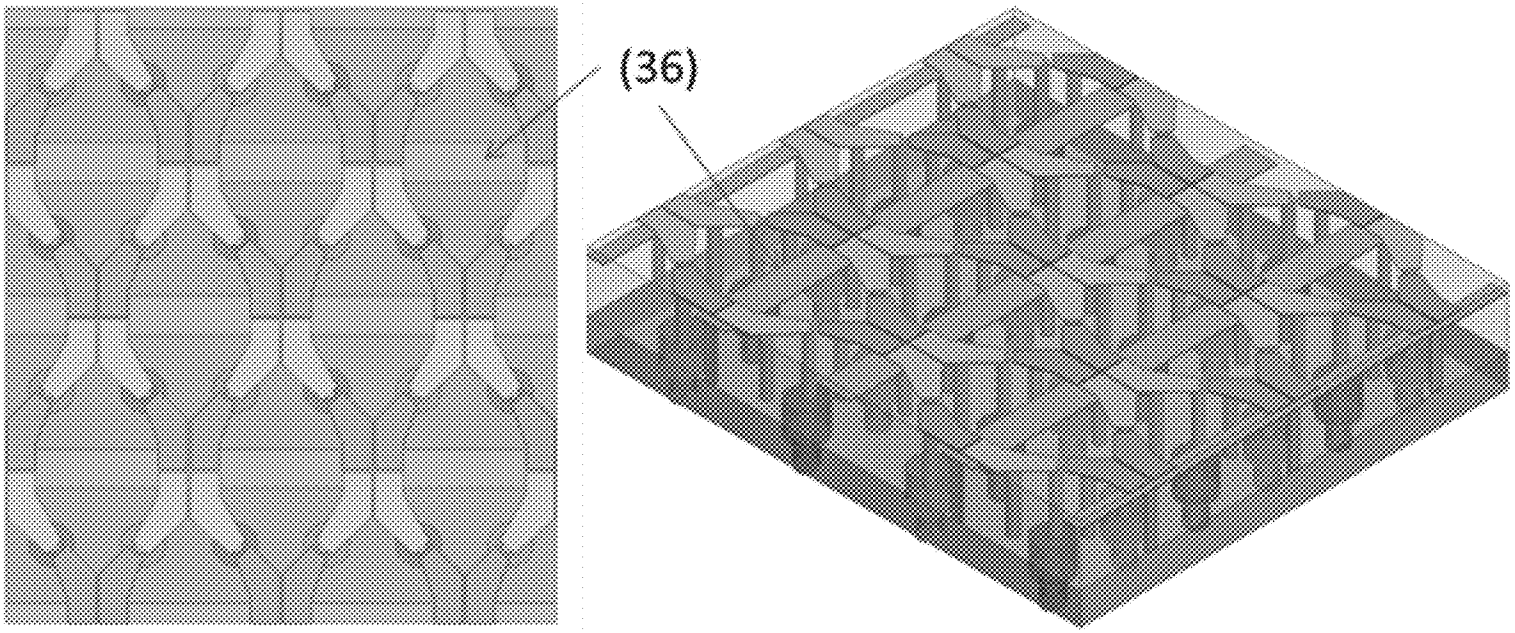
FIG. 10 is another diagram of a planar printed STV dipole in accordance with an embodiment of the present disclosure.

FIG. 10 is another diagram of a planar printed STV dipole in accordance with an embodiment of the present disclosure. FIG. 10 shows a top view (left) and an aspect view (right). In FIG. 10, a capacitively-coupled mode partition is printed on a separate layer from radiator arms. Alternatively, other embodiments may feature the mode partition printed on a separate layer than the radiating arms of the dipole, as shown in FIG. 10. In an embodiment, the mode partition can appear separately from the dipole artwork for structural reasons or manufacturing constraints. Additionally, implementing the mode partition as a separate layer or structure 36 can beneficially impact capacitive coupling for increased operational bandwidth.

Figure 11:
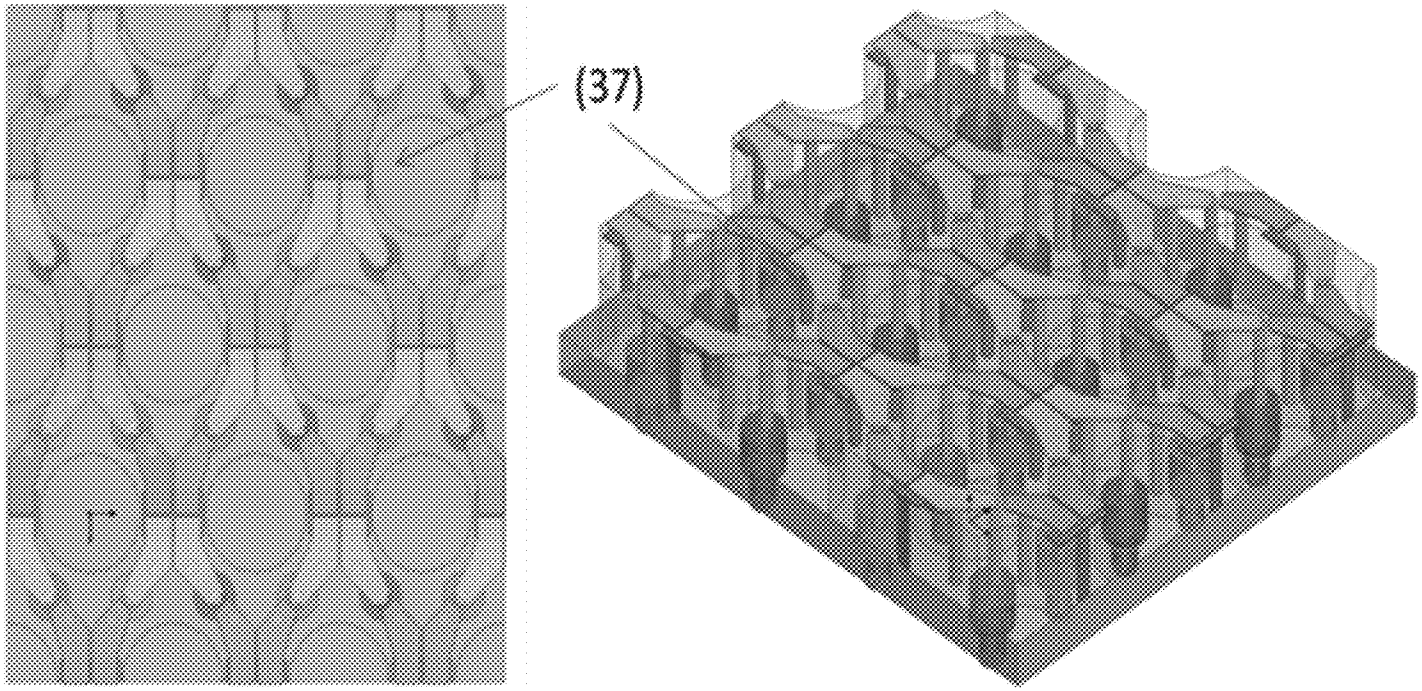
FIG. 11 is another diagram of a planar printed STV dipole in accordance with an embodiment of the present disclosure.

FIG. 11 is another diagram of a planar printed STV dipole in accordance with an embodiment of the present disclosure. FIG. 11 shows a top view (left) and aspect view (right). In FIG. 10, a capacitively-coupled mode partition is printed on a separate layer from radiator arms, and a perforated mode partition is used. As shown in FIG. 11, the mode partition can appear as a separate structure (or on a separate printed layer) and also be perforated, i.e., exist as a perforated mode partition 37.

Figure 12:
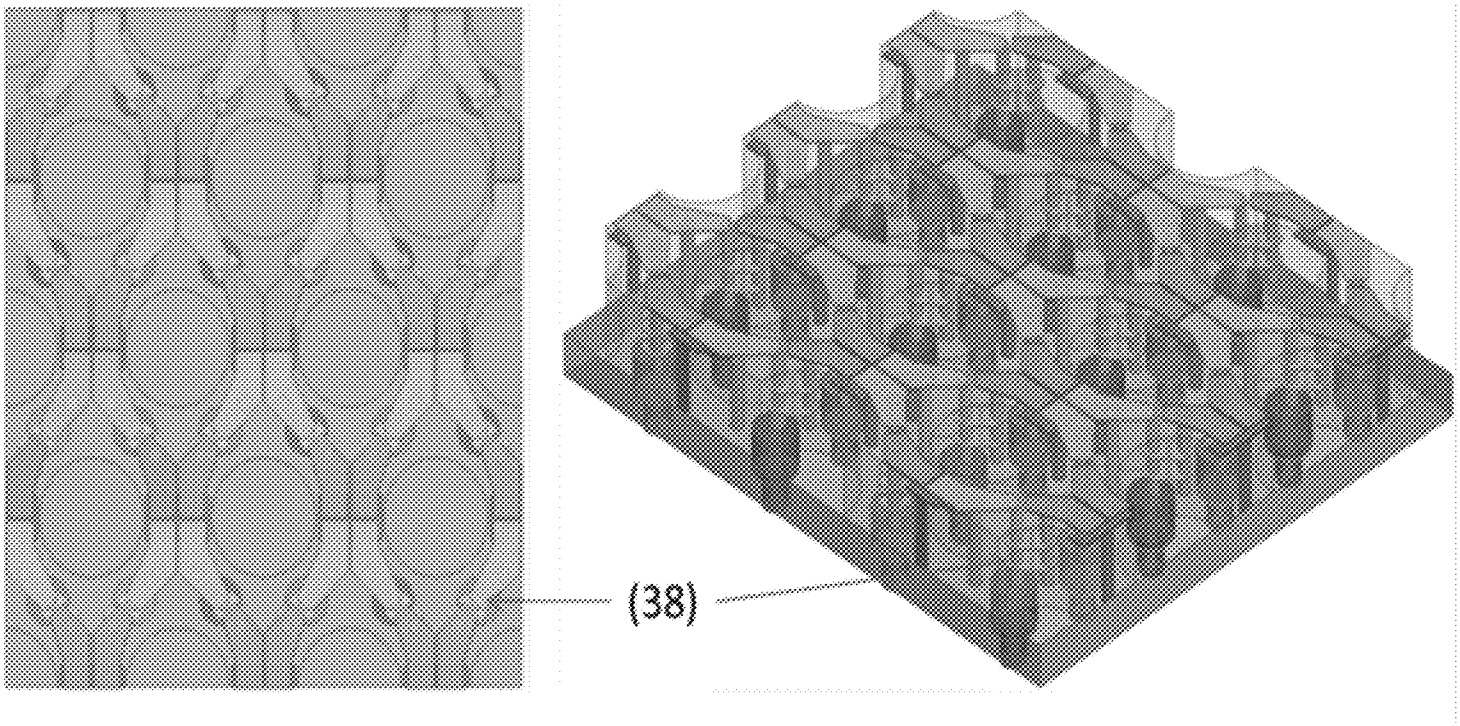
FIG. 12 is another diagram of a planar printed STV dipole in accordance with an embodiment of the present disclosure.

FIG. 12 is another diagram of a planar printed STV dipole in accordance with an embodiment of the present disclosure. FIG. 12 shows a top view (left) and an aspect view (right). In FIG. 12, a capacitively-coupled mode partition is printed on a separate layer from radiator arms, and a perforated mode partition with ribs is used. FIG. 12 includes additional tuning ribs 38 on the feed and ground vias. The number of ribs per via pair and the shape can vary and can largely serve to tune capacitance in the feed lines.

Figure 13:
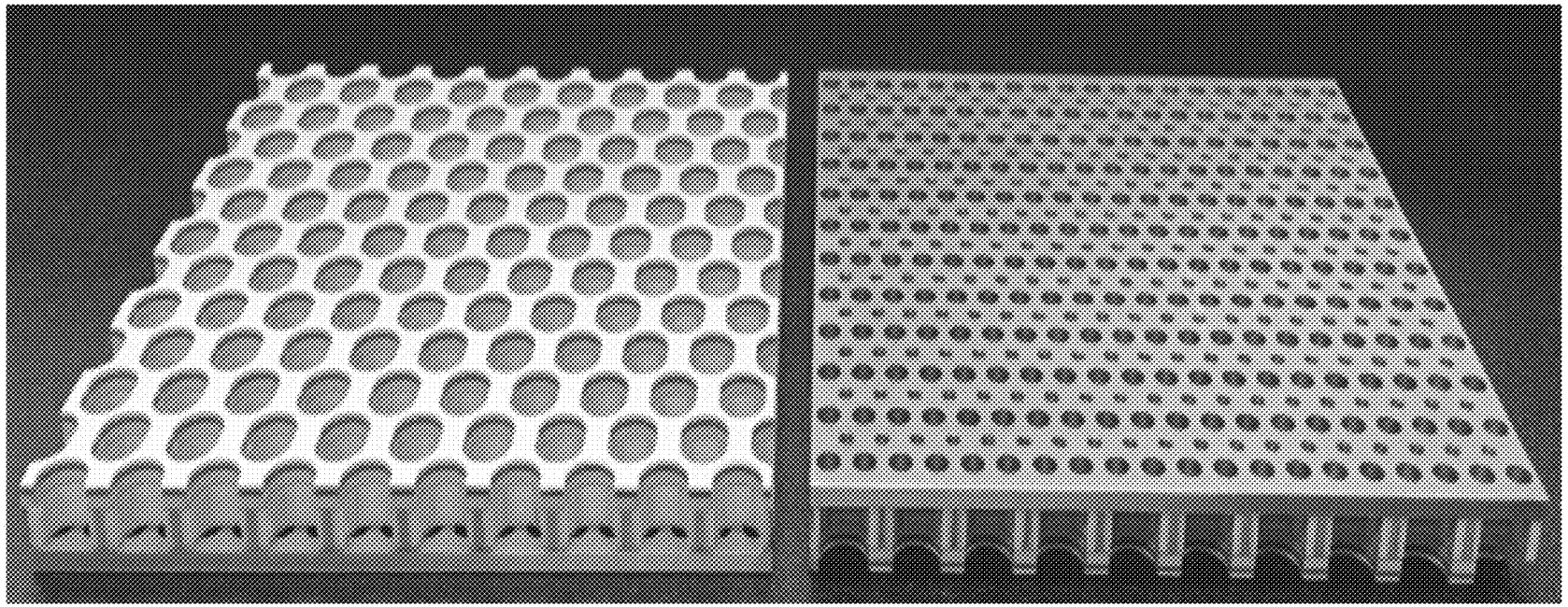
FIG. 13 shows images of exemplary manufactured prototypes of the planar printed STV antenna array in accordance with an embodiment of the present disclosure.

FIG. 13 shows images of exemplary manufactured prototypes of the planar printed STV antenna array in accordance with an embodiment of the present disclosure. FIG. 13 shows a top view (left) showing the equilateral triangle arrangement and a bottom view (right) showing the port placement on the rectangular grid. The concept described above with reference to FIGS. 8-13 has been verified to work, and have improved performance over other planar printed dipoles. The validated design appears to perform very well over more than a 3:1 operational VSWR bandwidth.

6. Exemplary Low-Profile, Metal-Machined Slant Tri-V Radiator

An exemplary low-profile, metal-machined (Lo-Pro-Meta) embodiment of a slant tri-V element will now be discussed with reference to FIGS. 14 and 15. In an embodiment, this STV element is manufactured via machining metal. Like the metal-machined Vivaldi STV discussed earlier, a Lo-Pro-Meta STV in accordance with an embodiment of the present disclosure can be conveniently machined as modular cores from single blocks of metal stock, or in reverse, be built up via additive manufacturing. In an embodiment, the design for the radiator can be sent to a single machining facility, which can in turn deliver a fully ready to operate array aperture (minus the connecting hardware) from a single-point manufacturing process, whether it be additive or subtractive manufacturing.

Figure 14:
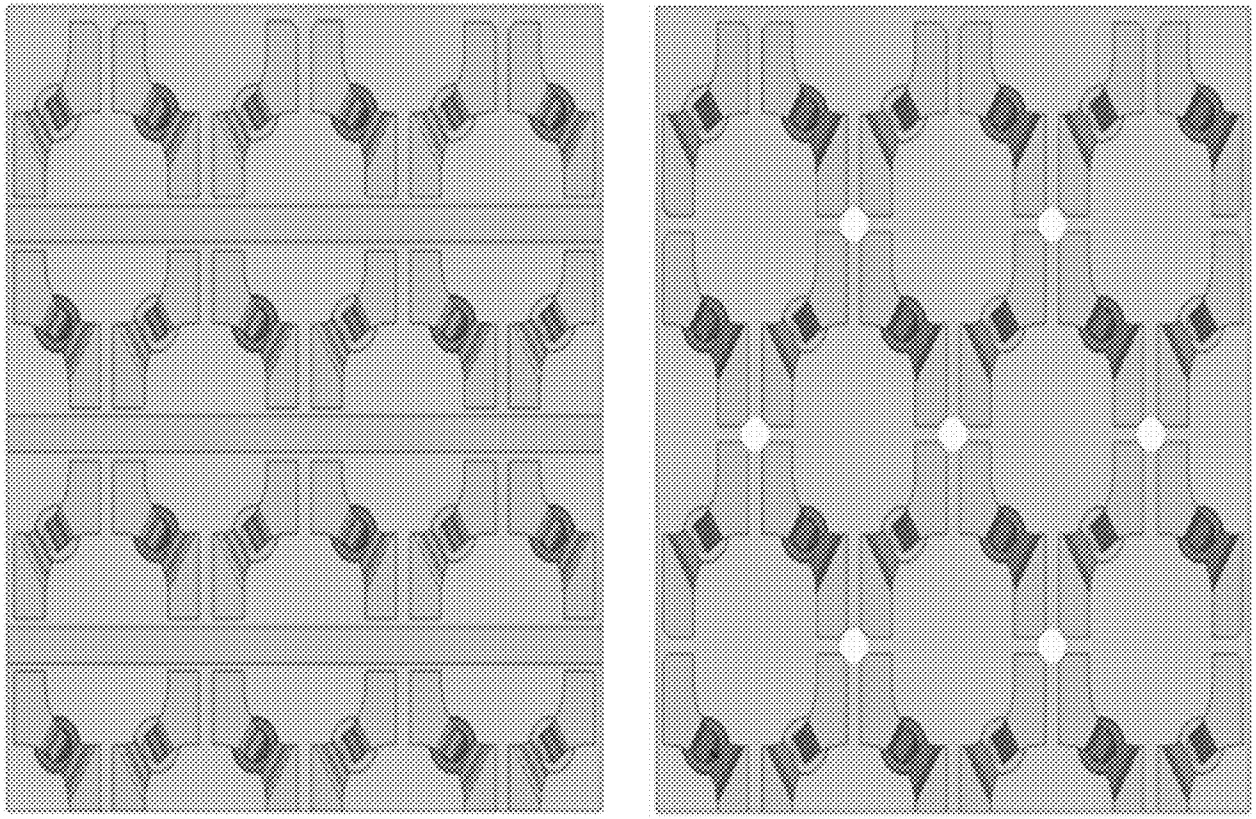
FIG. 14 shows diagrams of a low-profile, metal-machined STV element in accordance with an embodiment of the present disclosure.
Figure 15:
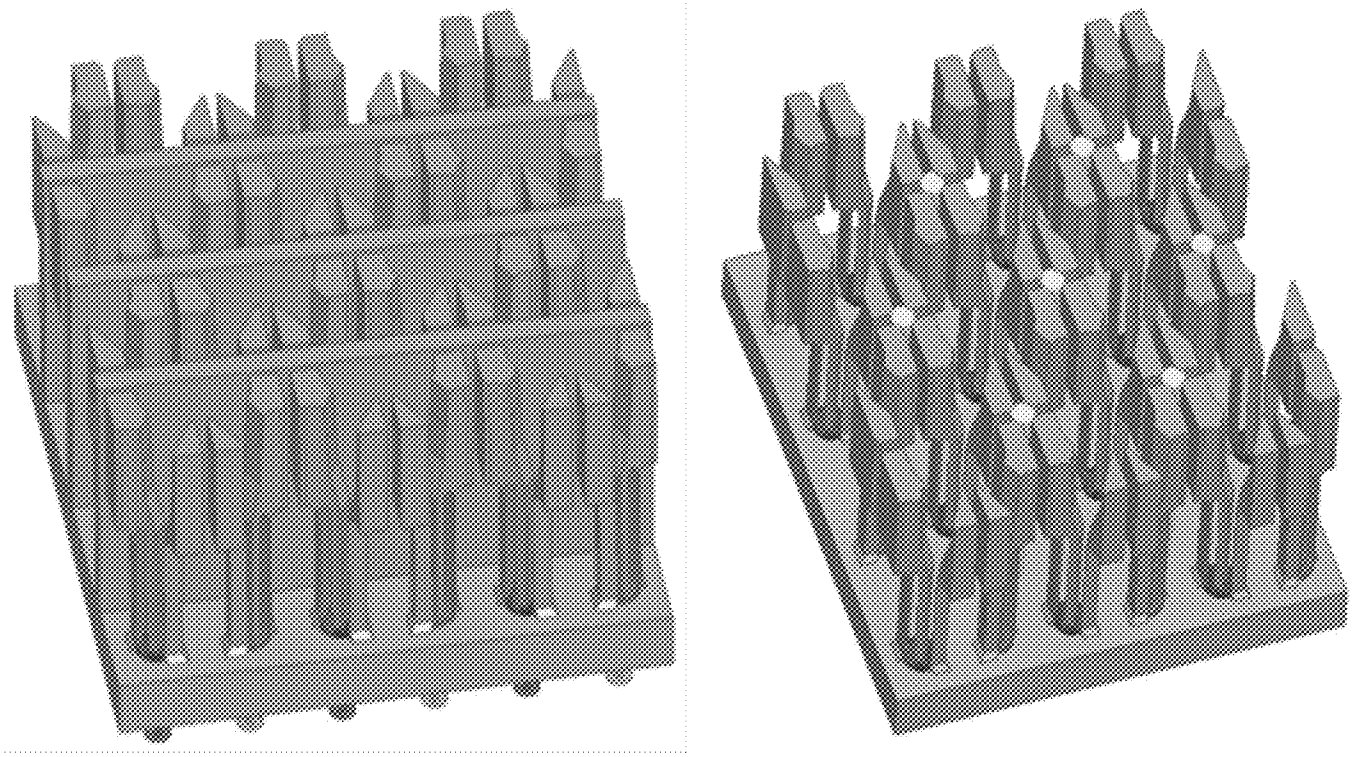
FIG. 15 shows diagrams of angular views of the low-profile, metal-machined STV element of FIG. 14 in accordance with an embodiment of the present disclosure.

FIG. 14 shows diagrams of a low-profile, metal-machined STV element in accordance with an embodiment of the present disclosure. FIG. 14 shows full mode partitions (left) and perforated mode partition bars (right). FIG. 15 shows diagrams of angular views of the low-profile, metal-machined STV element of FIG. 14 in accordance with an embodiment of the present disclosure.

7. Exemplary Slant Tri-V Embedded Vertical Cards

Figure 16:
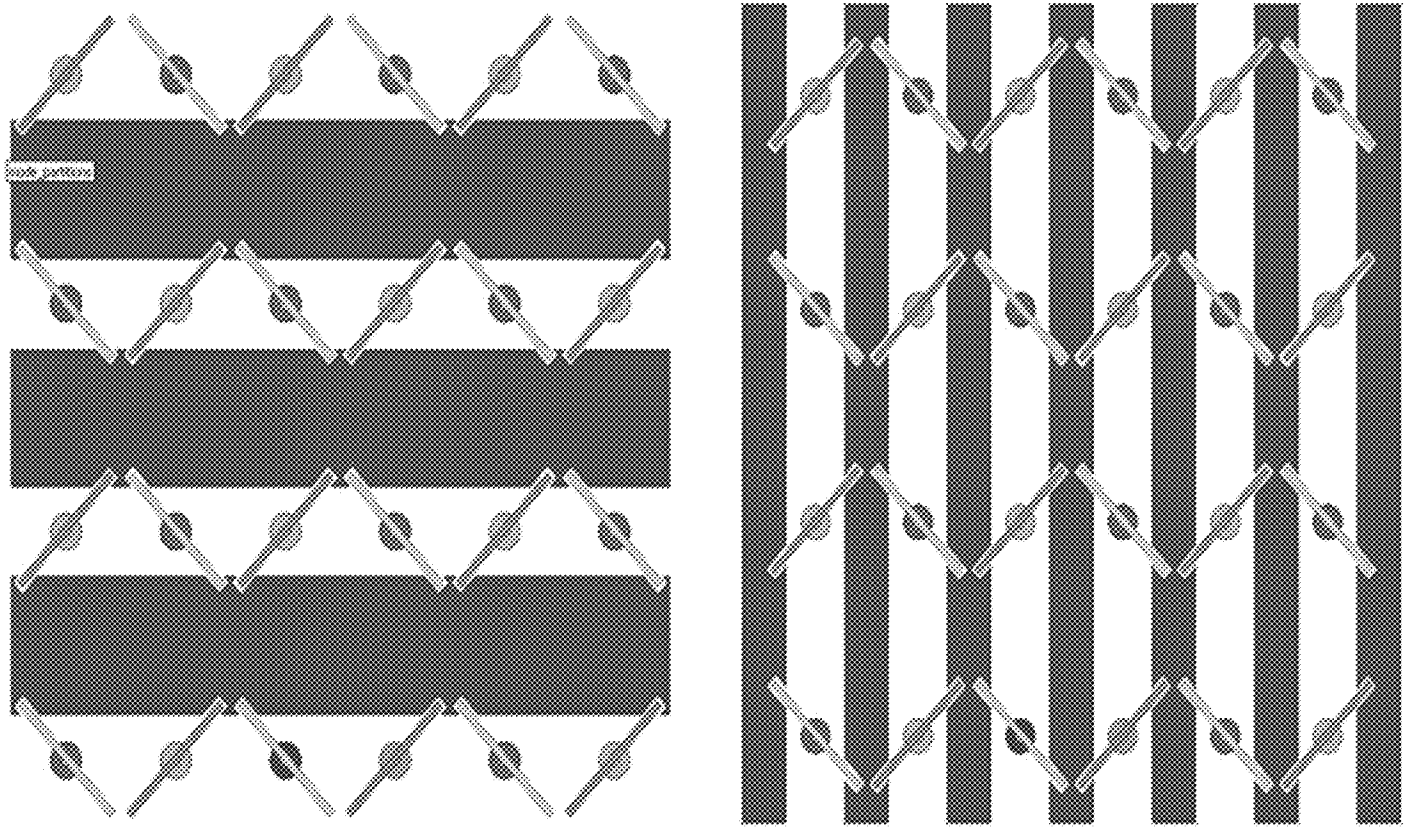
FIG. 16 shows diagrams of an exemplary embedded vertical card STV for horizontal (left) and vertical (right) mode partitions in accordance with an embodiment of the present disclosure.

FIG. 16 shows diagrams of an exemplary embedded vertical card STV for horizontal (left) and vertical (right) mode partitions in accordance with an embodiment of the present disclosure. FIG. 16 shows how the Slant Tri-V architecture can be realized for typical vertical printed-circuit-board card radiators. Without loss of generalization, the vertical cards could be Vivaldi elements, balanced antipodal Vivaldi elements, vertically printed dipole radiators such as the FUSE or tightly-coupled dipole antennas, sliced notch antenna elements, etc. Individual radiator cards can be nested between the mode suppression bars or mode partitions. The individual antenna cards can be electrically connected with the mode partitions, or they can be capacitively coupled. In an embodiment, two alternative constructions include one with horizontal partitions and one with vertical partitions. Performance can be tuned such that either embodiment could be viable depending on structural needs/considerations.

Figure 17:
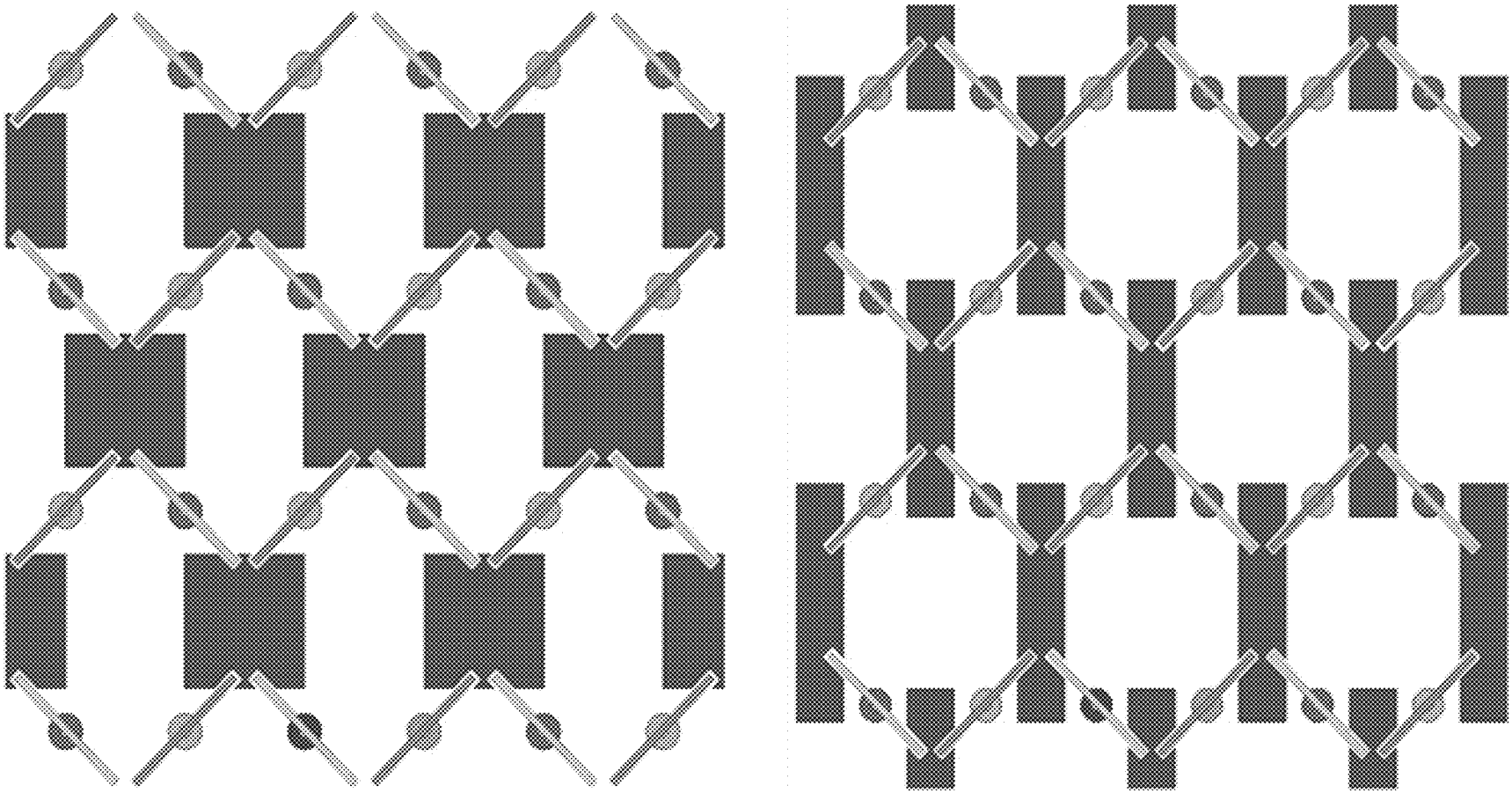
FIG. 17 shows diagrams of an exemplary embedded vertical card STV for horizontal (left) and vertical (right) mode partitions with breaks/perforations in the partition in accordance with an embodiment of the present disclosure.

FIG. 17 shows diagrams of an exemplary embedded vertical card STV for horizontal (left) and vertical (right) mode partitions with breaks/perforations in the partition in accordance with an embodiment of the present disclosure. Similar to other embodiments of the STV, the mode partitions for vertical card radiators can be perforated or feature breaks at regular intervals such as in FIG. 17. Again, this can be done for tuning considerations, construction considerations, or possibly simply weight reduction considerations, depending on the material from which the mode partition is made.

Figure 18:
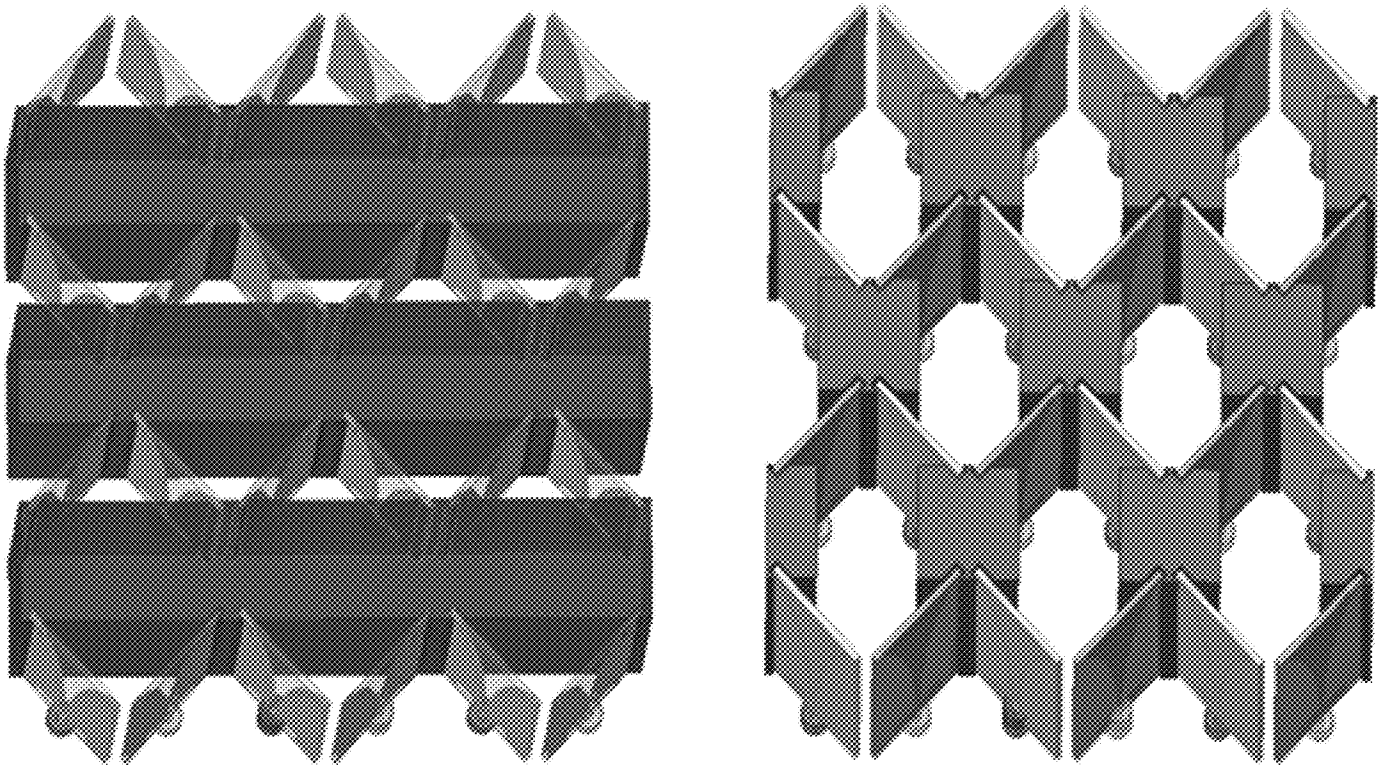
FIG. 18 shows other diagrams of an exemplary embedded vertical card STV for horizontal (left) and vertical (right) mode partitions with breaks/perforations in the partition in accordance with an embodiment of the present disclosure.

FIG. 18 shows other diagrams of an exemplary embedded vertical card STV for horizontal (left) and vertical (right) mode partitions with breaks/perforations in the partition in accordance with an embodiment of the present disclosure. One specific embodiment is shown below for Vivaldi-type STV elements. FIG. 18 shows an example of the STV configuration for a Vivaldi flare embedded as a vertical printed circuit board card into the mode partition. The slant-oriented elements embed into groves on the mode partition for electrical contact. The left image in FIG. 18 shows the case for continuous mode partitions, and the right image shows a reduced-weight concept with truncated partitions.

Figure 19:
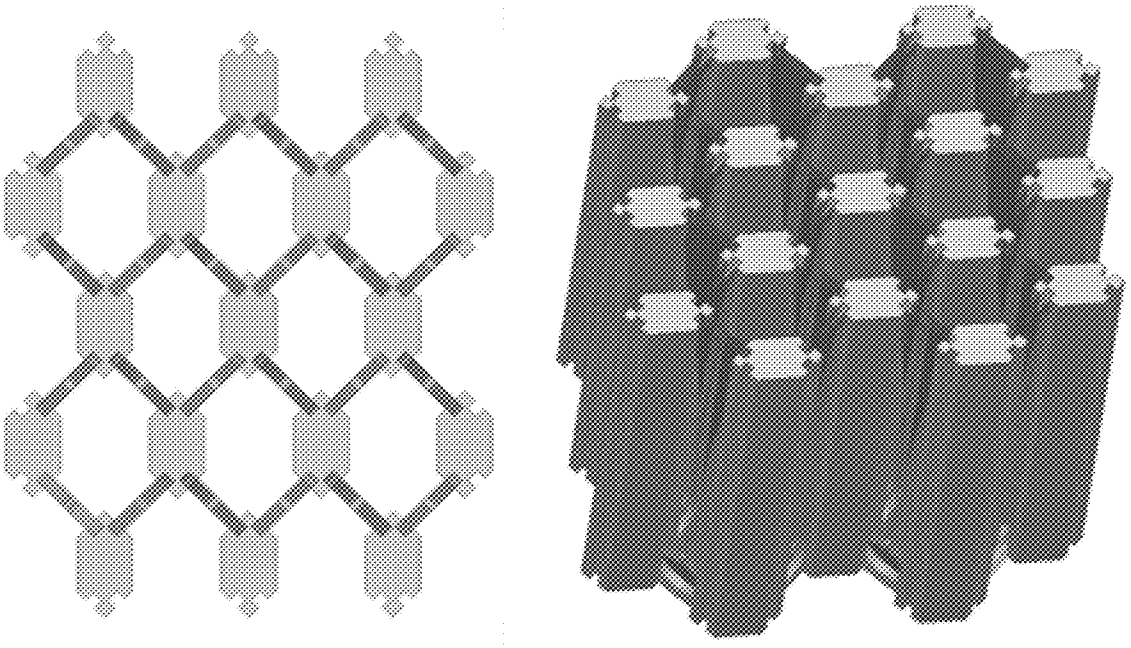
FIG. 19 shows other diagrams of an exemplary embedded vertical card STV for horizontal (left) and vertical (right)

FIG. 19 shows other diagrams of an exemplary embedded vertical card STV for horizontal (left) and vertical (right) mode partitions with breaks/perforations in the partition in accordance with an embodiment of the present disclosure. In FIG. 19, Vivaldi flares printed on substrate material are arranged in the STV configuration such that the flares fit the requisite equilateral triangle element placement to satisfy grating lobe requirements.

8. Exemplary Advantages

A Slant Tri-V (STV) element family in accordance with embodiments of the present disclosure embodies and encompasses a group of wideband, dual-polarized electrically coupled or connected radiators on a triangular lattice. The STV represents possibly the only element configuration that can easily produce a regular (rectangular) grid of feed ports (for convenient placement of electronics), while the relative element positioning clearly satisfies the requisite conditions of an equilateral triangle grid, allowing for maximum grating-lobe-free scan capability in the most efficiently sampled array aperture for cost/weight reductions. This allows for convenient mapping of electronics chains normally designed for regular rectangular grids to be paired with radiators placed on the maximally efficient (lowest element count) grating-lobe-free triangular lattices, as described below.

As an important note—the effect on scan blindness of the increased element spacing is often overlooked. That is to say, though it is well known that increased element spacing shifts scan blindness anomalies (catastrophically) to lower frequencies, it is often overlooked that for triangular vs. square lattices of the same radiator, scan blindness will likely be more problematic in the triangular lattice array for the same reason, as the triangular lattice has increased element spacing compared to the square lattice. That said, the STV has a built-in feature, referred to most generally as a mode partition, to mitigate any reduction in scan blindness frequencies, protecting wide scan capability at the high end of the operational frequency band. The mode partition can be implemented in any number of ways depending on how the STV element array is manufactured, as described below in several embodiments of the structure.

9. Conclusion

It is to be appreciated that the Detailed Description, and not the Abstract, is intended to be used to interpret the claims. The Abstract may set forth one or more but not all exemplary embodiments of the present disclosure as contemplated by the inventor(s), and thus, is not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments.

What is claimed is:

1. A dual-polarized antenna array, comprising:

a first element of a first polarization;

a first element of a second polarization coupled to the first element of the first polarization;

a first mode partition coupled to the first element of the first polarization;

a second element of the second polarization coupled to the first mode partition;

a second element of the first polarization coupled to the second element of the second polarization; and a second mode partition coupled to the second element of the first polarization and the first element of the second polarization.

2. The dual-polarized antenna array of claim 1, wherein the second polarization is orthogonal to the first polarization.

3. The dual-polarized antenna array of claim 1, wherein a horizontal spacing between the first element of the first polarization and the first element of the second polarization is $$\frac{2}{\sqrt{3}}$$

times a square lattice spacing used for grating-lobe free scan operation.

4. The dual-polarized antenna array of claim 1, wherein a horizontal spacing between the first element of the first polarization and the first element of the second polarization is half-wavelength spacing at a highest frequency of operation.

5. The dual-polarized antenna array of claim 1, wherein a vertical spacing between the first element of the first polarization and the second element of the first polarization is half a wavelength at a highest frequency operation.

6. The dual-polarized antenna array of claim 1, wherein a vertical spacing between the first element of the second polarization and the second element of the second polarization is half a wavelength at a highest frequency operation.

7. The dual-polarized antenna array of claim 1, wherein the first mode partition is parallel with the second mode partition.

8. The dual-polarized antenna array of claim 1, wherein the dual-polarized antenna array comprises a plurality of perforations, and wherein a first perforation in the plurality of perforations is between the first mode partition and the second mode partition.

9. The antenna array of the claim 1, wherein the plurality of perforations comprise drill holes.

10. The antenna array of the claim 1, wherein the plurality of perforations comprise counterbores.

11. The antenna array of the claim 1, wherein the first mode partition is electrically coupled to the first element of the first polarization and to the second element of the second polarization, and wherein the second mode partition is electrically coupled to the second element of the first polarization and to the first element of the second polarization.

12. The antenna array of the claim 1, wherein the first mode partition is capacitively coupled to the first element of the first polarization and to the second element of the second polarization, and wherein the second mode partition is capacitively coupled to the second element of the first polarization and to the first element of the second polarization.

13. A dual-polarized antenna array, comprising:

a first element of a first polarization;

a first element of a second polarization coupled to the element of the first polarization;

a mode partition bar coupled to the first element of the first polarization and to the first element of the second polarization;

a second element of the second polarization coupled to the mode partition bar; and a second element of the first polarization coupled to the second element of the second polarization and to the mode partition bar.

14. The dual-polarized antenna array of claim 13, wherein the mode partition bar comprises a polarizing structure including a plurality of layers.

15. The dual-polarized antenna array of claim 14, wherein the polarizing structure comprises a plurality of gaps in between respective layers in the plurality of layers, wherein the plurality of gaps are configured to enable formation of magnetic fields between elements of the dual-polarized antenna array.

16. A dual-polarized antenna array, comprising:

a first element of a first polarization;

a first element of a second polarization coupled to the first element of the first polarization;

a first mode partition coupled to the first element of the first polarization;

a second element of the second polarization coupled to the first mode partition;

a second element of the first polarization coupled to the second element of the second polarization;

a second mode partition coupled to the second element of the first polarization and the first element of the second polarization, wherein a first perforation is formed between the first mode partition and the second mode partition, and wherein the first mode partition is parallel with the second mode partition;

a third element of the first polarization coupled to the first mode partition and to the second element of the second polarization; and a third mode partition coupled to the third element of the first polarization.

17. The dual-polarized antenna array of claim 16, further comprising:

a third element of the second polarization coupled to the third mode partition;

a fourth element of the first polarization coupled to the third element of the second polarization; and a fourth mode partition coupled to the fourth element of the first polarization and to the second element of the second polarization.

18. The dual-polarized antenna array of claim 16, wherein a second perforation is formed between the third mode partition and the fourth mode partition.

19. The antenna array of the claim 16, wherein the first mode partition is electrically coupled to the first element of the first polarization and to the second element of the second polarization, and wherein the second mode partition is electrically coupled to the second element of the first polarization and to the first element of the second polarization.

20. The antenna array of the claim 16, wherein the first mode partition is capacitively coupled to the first element of the first polarization and to the second element of the second polarization, and wherein the second mode partition is capacitively coupled to the second element of the first polarization and to the first element of the second polarization.

* * * * *